United States Patent [19]

Gay et al.

[11] Patent Number: 4,636,336

[45] Date of Patent: Jan. 13, 1987

[54] PROCESS FOR DRYING A CHELATING AGENT

[75] Inventors: Richard L. Gay, Canoga Park; LeRoy F. Grantham, Calabasas, both of Calif.

[73] Assignee: Rockwell International Corporation, El Segundo, Calif.

[21] Appl. No.: 667,784

[22] Filed: Nov. 2, 1984

[51] Int. Cl.[4] ..... G21F 9/08; G21F 9/14; F23G 5/12

[52] U.S. Cl. ..... 252/632; 110/237; 110/238; 110/342; 159/47.3; 159/DIG. 12; 252/628; 252/629; 252/631

[58] Field of Search ..... 252/626, 631, 632, 628, 252/629; 159/47.3, DIG. 12; 501/152; 110/237, 238, 342, 346, 343, 345

[56] References Cited

U.S. PATENT DOCUMENTS

| | | | |
|---|---|---|---|
| 3,008,904 | 11/1961 | Johnson, Jr. et al. | 252/632 |
| 3,101,258 | 8/1963 | Johnson | 23/277 |
| 3,922,974 | 12/1975 | Hempelmann | 110/8 R |
| 4,053,432 | 10/1977 | Tiepel et al. | 252/632 |
| 4,145,396 | 3/1979 | Grantham | 423/22 |
| 4,235,738 | 11/1980 | Knotik et al. | 252/632 |
| 4,285,830 | 8/1981 | Müller | 252/632 |
| 4,499,833 | 2/1985 | Grantham | 252/631 |

FOREIGN PATENT DOCUMENTS

| | | | |
|---|---|---|---|
| 2907984 | 9/1979 | Fed. Rep. of Germany | 252/632 |
| 0094199 | 7/1980 | Japan | 252/632 |

*Primary Examiner*—Stephen J. Lechert, Jr.
*Assistant Examiner*—Howard J. Locker
*Attorney, Agent, or Firm*—H. Frederick Hamann; Harry B. Field; Clark E. DeLarvin

[57] ABSTRACT

A process is described for reducing the volume of a liquid waste containing an organic amine chelating agent in which a finely atomized spray of the liquid waste is contacted with a gas stream having a temperature in excess of the thermal decomposition temperature of the chelating agent. The proportions of the hot gas stream and liquid waste are controlled to rapidly evaporate water from the liquid waste and cool the gas to a temperature below the decomposition temperature of the chelating agent in a time of less than about 6 seconds to produce a dry, flowable powder product including the chelating agent.

8 Claims, No Drawings

PROCESS FOR DRYING A CHELATING AGENT

BACKGROUND OF THE INVENTION

1. Field of the Invention

This invention broadly relates to drying an organic amine chelating agent and more particularly to the volume reduction of an aqueous medium containing the same. In one of its more particular aspects this invention relates to a process for reducing the volume of a low-level radioactive aqueous waste containing an organic amine chelating agent. In another of its more particular aspects, this invention relates to a process for producing a dry, flowable powder from such a waste.

2. Prior Art

Waste management frequently involves the necessity of disposing of large volumes of materials, some of which may be contaminated with hazardous substances. In nuclear power plants, for example, large amounts of radioactive liquid and solid wastes are produced. Low-level radioactive wastes differ from high-level radioactive wastes, which are produced in the reprocessing of nuclear fuels, in that the latter present greater risks of contamination and therefore require disposal techniques which are more stringent than in the case of low-level radioactive wastes. Disposal of radioactive wastes in general cannot be readily accomplished by using conventional waste disposal techniques. Because of the relatively long half-lives of certain radioactive elements, the most widely used disposal techniques are storage, solidification and burial. The expense of so disposing of large volumes of radioactive wastes, however, is constantly rising and approaching levels at which volume reduction becomes not only economically desirable but a necessity.

Many efforts have been directed at reducing the volume of radioactive wastes.

U.S. Pat. No. 3,101,258 describes a heated-wall spray calcination reactor useful for disposing of nuclear reactor waste solutions. In spray calcination reactors of the heated-wall type, however, the temperature gradient from the outside of the reactor inward may result in uneven heating, producing regions of undesired high temperatures and causing non-uniform results.

U.S. Pat. No. 3,922,974 discloses a hot air-fired furnace for incinerating radioactive wastes. The use of this apparatus, however, results in the production of noxious off-gases which require additional processing for removal.

U.S. Pat. No. 4,145,396 describes a process for reducing the volume of organic waste material contaminated with at least one volatile compound-forming radioactive element selected from the group consisting of strontium, cesium, iodine and ruthenium. The selected element is fixed in an inert salt by introducing the organic waste and a source of oxygen into a molten salt bath maintained at an elevated temperature to produce solid and gaseous reaction products. The molten salt bath comprises one or more alkali metal carbonates and may optionally include from 1 to about 25 wt. % of an alkali metal sulfate. Although effective to some extent in reducing the volume or organic wastes, further volume reduction involving the separation of the radioactive materials from the non-radioactive components of the molten salt bath requires a number of additional processing steps.

In U.S. patent application Ser. No. 451,516, filed Dec. 20, 1982 (now U.S. Pat. No. 4,499,833) and assigned to the assignee of the present invention, there is proposed a process for converting radioactive wastes in the form of liquids, solids and slurries into a mixture of a non-radioactive gas and a radioactive inorganic ash. In accordance with that process the radioactive waste is introduced as a finely atomized spray into a zone heated by means of a hot gas to a temperature sufficient to effect the desired conversion, preferably a temperature in the range of about 600° to 850° C. The process is conducted in a spray dryer modified to combust or calcine the waste.

While the foregoing patent application discloses a process which is satisfactory for destroying most radioactive wastes, the high-temperature utilized in the process can produce noxious gases such as $NO_x$ or $SO_x$, the removal of which necessitates taking additional measures to ensure that any gas ultimately released to the atmosphere is non-polluting. In addition, such high temperatures may cause the volatilization of radionuclides from the radioactive waste and vaporization of some of the constituents of the waste material.

In the nuclear industry various organic amine chelating agents are utilized for cleaning the interior surfaces of the primary coolant loop of the reactor, a typical chelating agent being ethylenediaminetetraacetic acid (EDTA). Such chelating agents are used extensively for cleaning the interior surfaces of the primary coolant loop since they have an affinity for a variety of metal ions. In use, the chelating agent is used in an aqueous medium. Since the acid form of the chelating agent is substantially immiscible in water, it is common practice to add a material to increase its solubility. Typically, the material will be a sodium salt of the chelating agent. After use, the aqueous medium will also contain radioactive isotopes of various metals such as cobalt, manganese, cesium, iron etc.

Heretofore there has been no truly effective way of treating such an aqueous medium. More specifically, the chelating agent contains both a source of oxygen and a source of fuel and has a relatively low decomposition temperature. Thus, treatment at any elevated temperature would result in decomposition and combustion of the chelating agent. Conversely, if treated at a lower temperature to evaporate water and reduce the volume, the resulting residue has a sticky consistency and is difficult to handle or transport. The reason is not known with certainty, but is surmised that perhaps the combination of the chelating agent, metal ions and sodium salt form a highly hydrated complex at temperatures below the decomposition temperature of the chelating agent.

Typically, the aqueous medium containing the chelating agent and metal ion have a very low radioactivity and it would be acceptable to bury the solids content of the aqueous medium in drums in special, set-aside areas where ground water leakage and interaction with other radionuclides are controlled. The complex formed between the chelating agent and the metal ion, however, is water soluble. Thus, the common method for disposal of a spent aqueous medium containing a chelating agent is by solidification in cement. Obviously, this type of disposal technique will generally result in a net increase in volume. Further, the overall cost for such a disposal technique is quite high.

Consequently, there is a need for a process which can be used to reduce the volume of such a radioactive waste without producing noxious off-gases or volatilizing the chelating agent or radionuclides. This need is particularly pronounced in the case of liquid low-level radioactive wastes where large volumes of wastes of relatively low radioactivity compound the problems and costs involved in their transportation and disposal.

SUMMARY OF THE INVENTION

In general, the present invention provides a process for reducing the volume of a low-level radioactive liquid waste containing an organic amine chelating agent by spray drying to produce a dry, flowable solid product containing the radioactive materials and chelating agent which is readily disposed of. The process broadly comprises introducing the liquid waste in the form of a finely atomized spray into a spray dryer and into intimate contact with a hot gas stream.

A key aspect of the present invention is the use of a hot gas stream having a temperature in excess of the decomposition temperature of the chelating agent and controlling the proportions of the hot gas stream and liquid waste such that in a time of less than about six seconds water is rapidly evaporated from the liquid waste and the hot gas stream is cooled to a temperature below the decomposition temperature of the chelating agent. By so doing, it is possible to produce a dry, flowable powder product including the radioactive constituents of the waste and the chelating agent. There also is produced a gaseous product comprising water vapor and which is substantially free of volatile radioactive constituents from the waste. The gaseous product, after suitable purification to remove particulates, is sufficiently non-polluting to be released to the atmosphere.

The powder product, which is substantially reduced in volume compared to the volume of the initial waste, is readily disposed of by conventional means such as storage or burial or incorporation into a solid matrix such as a glass, ceramic, polymeric or concrete matrix prior to storage or burial.

DESCRIPTION OF THE PREFERRED EMBODIMENTS

The process of the present invention accomplishes volume reduction of a low-level radioactive liquid waste which contains free water and an organic amine chelating agent by contacting such waste in the form of a finely atomized spray with a hot gas to vaporize the water from the waste.

The present invention is applicable to a wide variety of organic amine chelating agents. It is particularly applicable to those more difficult to treat chelating agents such as the various organic amine acid compounds. Examples of such compounds are Ethylenediaminetetraacetic acid (EDTA), Diethylenetriaminepentaacetic acid (DTPA), Nitrilotriacetic acid (NTA) and N-Hydroxyethylethylenediaminetriacetic acid (HEDTA). Heretofore it was not believed possible that an aqueous medium containing such chelating agents in complex with metal ions could be readily dried in a short time to produce a flowable powder product. More particularly, at temperatures in excess of their decomposition temperature, even in an inert atmosphere, the compounds would decompose producing a combustible, potentially explosive, gaseous mixture. At temperatures below their decomposition temperature, after evaporation of the free water in a short residence time dryer, there is left a sticky residue which is not amenable to further processing which would require it to be passed through a conduit, pump, valve, or the like. An essential aspect of the present invention is that the hot gas and liquid waste containing the chelating agent be rapidly and intimately mixed to produce the desired powder product and cool the gas to a temperature below the decomposition temperature of the chelating agent in a time of from about 1 to 6 seconds. Thus, a spray dryer is uniquely suited for the practice of the present invention.

A particularly preferred apparatus in which to carry out the process of this invention is a heated gas spray dryer in which the hot gas is produced by burning a suitable gaseous, liquid or solid fuel with an oxygen-containing gas such as air, oxygen-enriched air or oxygen in a suitable burner. The resulting hot gas is then introduced into the spray dryer at a controlled rate to provide the desired temperature in the spray dryer. Any combustible gas, such as natural gas or propane; liquid, such as fuel oil or kerosene; or solid fuel, such as coal or coke, may be used in such a burner. Fuel oil is preferred as the fuel because of its lower cost and convenience. Alternatively, the hot gas may be produced by passing air or any other gas into contact with an electrical resistance heater or in indirect contact with some heating medium. Further, in some instances it may be advantageous to use an inert gas such as $CO_2$, $N_2$ and the like.

The initial temperature of the hot gas stream introduced into the spray dryer is a critical aspect of the present invention. Specifically, it is essential that the temperature be above the decomposition temperature of the chelating agent. If the temperature is not in excess of the decomposition temperature of the chelating agent then rather than obtaining the desired powder product there will be formed a sticky residue which will deposit on the walls of the spray dryer and the outlet ducting. Conversely of course, the temperature must not be so high that it cannot be rapidly reduced in less than about six seconds to a temperature below the decomposition temperature of the chelating agent. Thus the temperature will generally be within the range of from about 250° to 400° C.

Particularly good results are obtained by operating with an inlet hot gas temperature of from about 300° to 330° C. and cooling the gas to a temperature below the decomposition temperature of the chelating agent in a time of from about 1.5 to 3 seconds. The chelating agent-metal ion complex is recovered as a dry, dense flowable powder. The powder product is well suited for situations where the waste material will ultimately be solidified in, for example, concrete or storage without solidification.

In accordance with the invention, it is essential that the temperature of the hot gas be rapidly reduced to a temperature less than the decomposition temperature of the chelating agent. For convenience, the temperature is measured at the outlet of the spray dryer and should be within the range of from about 150° to 200° C. and preferably within the range of from about 165° to 190° C. In accordance with a preferred embodiment wherein the dry powder product is entrained in the gas stream and subsequently passed to a gas-solid separator such as a fabric filter, the temperature is further reduced to permit the use of conventional materials in the fabric filter. This preferably is accomplished by the introduction of dilution air at the exit of the spray dryer. In addition, since it is known that some chelating agents such as EDTA will begin to decarboxylate at temperatures as low as 150° C., this has the further advantage of eliminating any possibility of such decarboxylation occurring downstream of the spray dryer. This result obviously should be avoided when it is desired to recover the chelate and metal ion as a complex. Typically the temperature of the effluent mixture of gas and product powder will be reduced to less than about 90° C.

Since an essential feature of the invention involves the rapid cooling of the hot gas stream, the hot gas must be intimately contacted with a finely atomized spray of the low level radioactive, liquid waste to be treated. A spray dryer is uniquely suited for this purpose. The liquid waste is introduced into the spray dryer through a spray nozzle, atomizing disc, or other distribution means. The selection of the appropriate distribution means for any given liquid waste is well within the skill of those versed in the art of spray drying.

Spray drying of any of the above or any other low-level radioactive wastes, such as sludges, results in the production of a dry, flowable solid which contains the radioactive contaminants and a non-radioactive gas which, after filtering, can be released to the atmosphere as a non-polluting gas.

The process of the present invention has many advantages. The waste to be processed requires no pretreatment, such as pH adjustment, in order to be dried. The spray drying process described above is not composition dependent and can handle virtually any feed material that will produce a dry product.

The process may be carried out in an oxidizing atmosphere by utilizing an excess of an oxygen-containing gas; the solids produced are not decomposed or burned. This result is achieved by introducing the hot gas into the spray dryer at a temperature which is initially above the decomposition temperature of the chelating agent, and rapidly cooling the gas to a temperature which is still sufficiently high to assure that the material processed leaves the spray dryer in the form of a uniformly dry product.

At the low temperatures of operation of the spray dryer in the process of the present invention, partial oxidation of the waste is avoided. Thus nitrogen-containing chelating agents are completely dried without releasing $NO_x$ which would be formed by decomposition and oxidation of the agents.

Volatile fission products such as compounds of cesium or iodine in the liquid waste are contained in the solid product and not volatilized in the off-gases of the process.

The solid product of the process of this invention is a dry, flowable powder which is readily transported to disposal in drums, immobilized in a monolith in a solidification system, or compressed in drums using equipment which is similar to conventional equipment used to compress solid radioactive wastes.

These advantages are unique to the process of the present invention and provide an alternative to volume reduction processes currently in use for liquid wastes containing chelating agents, such as solidification of the liquid in cement with or without prior partial evaporation of the liquid.

The invention may be better understood by reference to the following examples which are intended to be illustrative of the process of the present invention and not in any way limitative thereof.

EXAMPLE 1

The apparatus utilized comprised a commercially available spray dryer constructed of stainless steel. From the spray dryer exhaust, gases with their entrained solids were ducted directly to a fabric filter (commercially available baghouse filter). Sampling locations for gas analysis were, among other places, at the spray dryer inlet before any liquid waste enters the spray dryer and the spray dryer outlet. $NO_x$ measurements were made with a chemiluminescence analyzer. Temperatures also were monitored with the output recorded on a chart recorder. The gas flow rates through the spray dryer were determined by standard pitot tube transfer flow measurements and pressure also was monitored. The average residence time of liquid waste and hot gas in the spray dryer was calculated using the known volume of the spray dryer and flow rates of the waste and gas.

A chelate-containing liquid waste was formulated comprising 90 wt. % water and 10 wt. % EDTA in complex with sodium. The waste was introduced into the spray dryer at ambient temperature where it was contacted with a hot gas having an average temperature of approximately 370° C. to produce in a time of about 1.6 seconds an outlet gas having an average temperature of about 173° C. and containing the dried chelating agent. The solid product was collected in the bag filter and recovered as a dry, flowable powder having a density of about 0.39 grams/cc. In contrast, utilizing the same waste and time it was found that if the outlet temperature was allowed to go below 150° that a sticky residue formed on the walls of the spray dryer in such thickness as to necessitate terminating the test.

EXAMPLE 2

A simulated copper-containing decontamination liquid waste was formulated. The liquid waste comprised 83.7 wt. % water, 2.5 wt. % EDTA, 5.3 wt. % tetrasodium EDTA, 5.2 wt. % ammonium hydroxide, 2.6 wt. % copper sulfate, and about 0.7 wt. % powdered anion and cation exchange resins. The exchange resins were added to act as abrasives to remove dried residue from the walls of the spray dryer. A finely atomized spray of the waste was introduced into the spray dryer where it was contacted with a hot gas stream having an initial or inlet temperature of 313° C. In a time of about 1.8 seconds the gas temperature (as measured at the outlet of the spray dryer) was about 185° C. The solid product was collected from the filter and found to be a dry, flowable powder having a density of about 0.25 grams/cc. During this test no increase in $NO_x$ was detected, thus demonstrating that the amine chelating agent had not undergone any decomposition.

EXAMPLE 3

A simulated iron decontamination liquid waste was formulated. The liquid waste comprised 76.5 wt. % water, 15.4 wt. % EDTA, 1.05 wt. % $FE_2O_3$ and 7.05 wt. % $NH_4OH$. The liquid waste was introduced into the spray dryer where it was contacted with a hot gas stream having an initial temperature of 313° C. In a time of about 2.1 seconds the gas temperature (as measured at the spray dryer outlet) was reduced to about 172° C. A solid product was recovered from the fabric filter in the form of a dry flowable powder which had a density of about 0.87 grams/cc. Further, throughout the test there was no increase in the $NO_x$ emissions which would have been indicative of any decomposition of the amine chelating agent.

It is believed that the foregoing examples clearly demonstrate the efficacy of the present invention to treat a liquid waste containing an organic amine chelating agent to produce a dry, flowable powder of the agent.

To demonstrate the benefits obtained from treating an organic amine chelating agent in accordance with the present invention, the following comparison is offered. When an EDTA liquid waste such as is described in Examples 2 and 3 is treated in accordance with the current required practice for such a low-level radioactive liquid waste containing an organic amine chelating agent, one cubic meter of the waste mixed with cement would produce a mixture which upon solidification, would have a volume of 1.7 cubic meters. In contrast, when that same waste from Example 3 is treated in accordance with the present invention it would produce a dry powder product having a volume of only 0.22 cubic meter and when blended with cement would have a volume of 0.56 cubic meter. Further, 1 cubic meter of the EDTA-copper liquid waste from Example 2, while producing a less dense powder, would still only have a volume of 0.48 cubic meter. When wetted and mixed with cement the resulting product would shrink to a volume of 0.21 cubic meter. Thus when the powder product from the present invention is processed in accordance with the current practice, the end product provides substantial reduction in volume and associated disposal cost. Similar benefits are obtainable when the powder product is solidified in other materials, for example, polymers currently used for such purpose. Thus, it is seen that the present invention makes possible what was heretofore believed to be unobtainable; namely, the rapid conversion of a waste containing an organic amine chelating agent into a dry, flowable powder. Further, the practice of the present invention provides a substantial economic benefit.

The process of the present invention is capable of substantially reducing the volume of low-level radioactive wastes while producing a dry, flowable radioactive solid product and a gaseous product which contains substantially no $NO_x$ and also retains volatile radionuclides in the solid product. In addition, greater volume reductions can be realized by compression of the spray-dried powder obtained in the process of this invention.

It will, of course, be realized that various modifications can be made to the design and operation of the process of this invention without departing from the spirit thereof. For example, waste materials other than those specifically exemplified herein can be spray dried according to the process of this invention. The material to be treated can be introduced into the spray dryer using various single or multiple fluid spray nozzles or other forms of atomizers. Multiple nozzles or atomizers can be used, if desired. In addition, other gas-solid separation means can be used to separate the gaseous and solid products of the process. For example, electrostatic or metal filters or cyclones may be used. Other ways of treating the gaseous and solid products following separation can be used, if desired. Thus, while the principle, preferred design and mode of operation of the invention have been explained and what is now considered to represent its best embodiment has been illustrated and described, it should be understood that, within the scope of the appended claims, the invention can be practiced otherwise than as specifically illustrated and described.

What is claimed is:

1. A process for reducing the volume of a low-level radioactive liquid waste containing an organic amine chelating agent comprising:

burning a fuel and an oxygen-containing gas to produce a hot gas stream having a temperature in excess of the thermal decomposition temperature of the chelating agent;

introducing the hot gas stream into a spray drying zone;

introducing a finely atomized spray of said liquid waste into said spray drying zone and into intimate contact with said hot gas stream;

controlling the proportions of said hot gas stream and said liquid waste to rapidly evaporate water from said liquid waste and cool said hot gas to a temperature below the decomposition temperature of said chelating agent in a time of less than six seconds to produce (a) a dry, flowable powder product including said chelating agent, and (b) a product gas substantially free of any gaseous products of said chelating agent and volatile fission products of the radioactive constituents of said liquid waste; and separating said powder product from said product gas.

2. The process of claim 1 wherein said chelating agent is an organic amine acid compound.

3. The process of claim 2 wherein said chelating agent is selected from the group consisting of EDTA, DTPA, HEDTA and NTA.

4. The process of claim 3 wherein said hot gas stream has a temperature within the range of 250° to 400° C.

5. The process of claim 4 wherein said hot gas is cooled to a temperature of from about 150° to 200° C. in a time within the range of from about 1 to 6 seconds.

6. The process of claim 5 wherein said time is within the range of from about 1.5 to 3 seconds.

7. The process of claim 6 wherein said chelating agent is EDTA.

8. The process of claim 5 wherein the gas is further cooled to a temperature of less than about 90° C. prior to separating said powder product from said product gas.

* * * * *

UNITED STATES PATENT AND TRADEMARK OFFICE

CERTIFICATE OF CORRECTION

PATENT NO. : 4,636,336

DATED : Jan. 13, 1987

INVENTOR(S) : Richard L. Gay et al.

It is certified that error appears in the above-identified patent and that said Letters Patent is hereby corrected as shown below:

Attorney, Agent, or Firm, delete "H. Frederick Hamann", insert therefor --H. Fredrick Hamann--.

Signed and Sealed this

Twenty-eighth Day of April, 1987

*Attest:*

DONALD J. QUIGG

*Attesting Officer*

*Commissioner of Patents and Trademarks*